US006626391B2

(12) United States Patent
Kretsch et al.

(10) Patent No.: US 6,626,391 B2
(45) Date of Patent: Sep. 30, 2003

(54) RETRACTABLE FENCE HAVING A LINE DISPENSER

(75) Inventors: Kevin R. Kretsch, Plymouth, MN (US); Alan W Cibuzar, Brainerd, MN (US)

(73) Assignee: Lake Restoration, Inc., Rogers, MN (US)

( * ) Notice: Subject to any disclaimer, the term of this patent is extended or adjusted under 35 U.S.C. 154(b) by 0 days.

(21) Appl. No.: 09/862,784

(22) Filed: May 21, 2001

(65) Prior Publication Data

US 2002/0171002 A1 Nov. 21, 2002

(51) Int. Cl.[7] ..... B65H 57/12

(52) U.S. Cl. ..... 242/397.1; 242/395.1; 242/422.5; 242/615.3

(58) Field of Search ..... 242/395.1, 395, 242/397, 397.1, 400, 422.4, 422.5, 422.9, 406, 615.3, 171

(56) References Cited

U.S. PATENT DOCUMENTS

| | | | | |
|---|---|---|---|---|
| 528,218 A | * | 10/1894 | Allison | |
| 675,043 A | * | 5/1901 | Hornback | |
| 680,342 A | * | 8/1901 | Martin | 52/298 |
| 1,378,948 A | * | 5/1921 | Hage | 52/298 |
| 1,592,030 A | * | 7/1926 | Langsner | 242/395.1 |
| 1,761,592 A | * | 6/1930 | Seidel | 242/395 |
| 2,102,917 A | * | 12/1937 | Rolland | 242/395 |
| 2,236,305 A | * | 3/1941 | Ahlin | 242/397 |
| 2,245,823 A | * | 6/1941 | Rappaport | 242/395 |
| 2,752,106 A | * | 6/1956 | Thompson | 242/422.5 |
| 3,148,417 A | | 9/1964 | Bellas | |
| 3,709,445 A | * | 1/1973 | Adams | 242/422.5 |
| 4,057,221 A | | 11/1977 | Leath | 256/40 |
| 4,070,007 A | | 1/1978 | Minor et al. | 256/19 |
| 4,531,682 A | * | 7/1985 | Schroder et al. | 242/615.3 |
| 4,937,988 A | | 7/1990 | Gratton | 52/101 |
| 5,092,088 A | | 3/1992 | Way | 52/101 |
| 5,332,196 A | | 7/1994 | Wright | 256/47 |
| 5,377,944 A | | 1/1995 | Getsinger | 248/218.4 |
| 5,570,537 A | | 11/1996 | Black et al. | 43/112 |
| 5,584,444 A | | 12/1996 | Farmer | 242/395 |
| 5,588,613 A | * | 12/1996 | Nagy | 242/395 |
| 5,606,830 A | | 3/1997 | Townsend, Jr. et al. | 52/101 |
| 5,649,690 A | | 7/1997 | Kilmer | 256/35 |
| 5,791,501 A | | 8/1998 | Baldwin | 211/183 |
| 5,845,607 A | | 12/1998 | Kastner et al. | 119/903 |
| 6,003,471 A | | 12/1999 | Ohba | 119/713 |
| 6,102,321 A | | 8/2000 | Clary | 242/388.4 |

FOREIGN PATENT DOCUMENTS

| | | |
|---|---|---|
| DE | 3820836 A1 | 12/1989 |
| GB | 960179 | 6/1964 |
| GB | 2250172 | 6/1992 |
| WO | WO-9316590 | 9/1993 |

OTHER PUBLICATIONS

Sax, N..I. ,et al. ,"Hawley's Condensed Chemical Dictionary", *11th Edition*, (Sep. 17, 1987),p. 938.

* cited by examiner

*Primary Examiner*—William A. Rivera
(74) *Attorney, Agent, or Firm*—Schwegman, Lundberg, Woessner & Kluth, P.A.

(57) ABSTRACT

A line dispenser for a retractable fence which includes a housing for holding a spool of line, the housing having a hole for communicating the line outside the housing; a crank for rotating the spool to bring the line into the housing through the hole; and a tube located within the hole. The line extends through the tube so that the tube applies a tension on the line as the line is reeled in and pulled out of the housing. This device provides a fence which is substantially tangle-free as the line is reeled into and pulled out of the housing. Another aspect provides a retractable fence which includes a line dispenser which holds a rotatable spool having a length of line thereon, the line dispenser being mounted on a starting post; means for rewinding said line onto the rotatable spool; at least one secondary post, said line traversable from the starting post to the secondary post and back to the starting post; wherein the starting post and at least one secondary post are set in receptacles and are reversibly removable therefrom.

22 Claims, 3 Drawing Sheets

RETRACTABLE FENCE HAVING A LINE DISPENSER

FIELD OF THE INVENTION

The present invention relates to a method and apparatus for averting trespass of geese and other waterfowl on property, and particularly to a retractable fence for such a purpose.

BACKGROUND

Lawns, walkways, picnic areas, and other properties adjacent to ponds, lakes and rivers are often frequented by waterfowl, with the drawback that these birds typically leave excrement throughout their wanderings over these properties. In recent decades, large numbers of Canadian geese have acclimated to human activity, and have exploded in number within urban centers, as well as suburban and rural lakes. Business properties and housing projects often include ponds and other waterways within open green spaces. These ponds naturally draw waterfowl, especially the aforementioned Canadian geese. Neighboring lawns provide particularly attractive feeding areas for these geese. A common sight at many such locations is a string of geese walking onto a lawn from the water's edge, to feed on the grass. These flocks of geese will even cross busy roadways to reach such attractive feeding areas. Golf courses are also plagued with geese populations for the same reasons.

One method to control the geese are crisscrossing lines of colored or reflective fibers strung over stroll ponds. These crisscrossing lines have been relatively effective on deterring flocks of waterfowl from landing on the ponds. These lines are unsightly, however, and are practical for use only on small bodies of water. They are totally unacceptable on ponds and lakes large enough to invite recreation with boats, canoes, and other personal water craft. Moreover, the lines become tangled when taken down, are difficult to store, and thus and are not easily re-usable.

Similarly, arrays of reflective streamers or lines loaded with reflective tinsel have been erected on water frontage properties to visually repel waterfowl. A large number of such streamers, erected by property owners in a localized area around a lake or pond, becomes in itself a visual blight. A further problem of such streamers is that they are difficult to remove and thus interfere with ordinary activities on the affected properties, including recreation, lawn mowing, and so forth. Again, such streamers become tangled when taken down, are difficult to store, and thus and are not easily re-usable.

Accordingly, what is needed is a method and means of waterfowl deterrence that is inexpensive, easily installed, easily taken down, and re-usable.

SUMMARY

One aspect of the present system includes a line dispenser for a retractable fence. In one embodiment, the line dispenser includes a housing for holding a spool of line, the housing having a hole for communicating the line outside the housing. The line dispenser also includes a crank for rotating the spool to bring the line into the housing through the hole and a tube located within the hole. The line extends through the tube so that the tube applies a tension on the line as the line is reeled in and pulled out of the housing. This device provides a retractable fence which is substantially tangle-free as the line is reeled into and pulled out of the housing and provides that the line is generally evenly wound back upon the spool without prominent peaks or valleys developing in the spooled line. Accordingly, the device can be re-used and is easily assembled and disassembled.

A further aspect of the present system includes a tensioning member for controlling a line as the line is being rewound on a spool. In one embodiment, the tensioning member includes a tube member flexibly biased towards a surface of the spool, wherein the line extends through the tube. This aspect provides a simple, easily manufactured device which controls a line so that the line is substantially tangle-free as the line is reeled upon a spool and provides that the line is evenly wound back upon the spool without prominent peaks or valleys developing in the spooled line. Accordingly, a reel including the tensioning member can be re-used indefinitely.

Another aspect of the present system provides a retractable fence. In one embodiment, a retractable fence includes a line dispenser which holds a rotatable spool having a length of line thereon, the line dispenser being mounted on a starting post. The retractable fence includes a secondary post, said line traversable from the starting post to the secondary post and back to the starting post. The starting post and the secondary post are set in receptacles and are reversibly removable therefrom. Such a retractable fence is easily removable when the owner or user of the property desires unfettered access to the full property, and is easily re-erected.

Among other advantages, the present system provides a retractable fence having easy installation, easy uninstallation, easy maintenance, and a substantially tangle-free system of extending and retracting the fence.

DETAILED DESCRIPTION

In the following detailed description, reference is made to the accompanying drawings that form a part hereof, and in which are shown by way of illustration specific embodiments in which the invention may be practiced. It is understood that other embodiments may be utilized and structural changes may be made without departing from the scope of the present invention.

Figure 1:
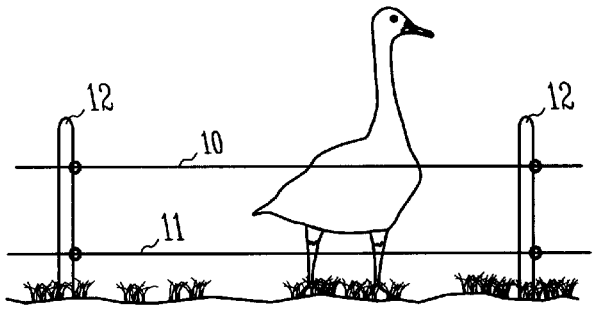
FIG. 1 is a schematic diagram of a simplified goose barrier.

FIG. 1 shows a waterfowl barrier fence, wherein two lines 10, 11 are suspended in air above the ground surface of a real estate property, these two lines defining a boundary on the surface that fences off a portion of the real estate property from trespass by geese on foot. These two lines are preferentially arranged so that they are not only generally parallel with the surface, and are also generally parallel with each other, one line being suspended above the other line. Where the surface of the boundary undulates or follows a non-level slope, the lines may not be exactly parallel with the boundary surface. Nevertheless, optimally they will be suspended so as to follow generally the contour of the boundary surface, this being understood and included in the meaning of the term "generally parallel." More than two lines may be employed, but it has been found that two lines are generally sufficient. Additionally, the two lines may be connected end-to-end to form a single overall line; otherwise stated, a single line may be continuously strung so as to include two portions of the single line equivalent to two lines suspended in accord with the description provided immediately above.

The two lines 10, 11 are suspended by means or a plurality of above-ground members or posts 12, preferably two or more stakes generally arranged vertically, with means for attachment of the lines to the above-ground members. These members may be metal rods, wooden stakes, rock or concrete formations, plastic or fiberglass articles, stems or trunks of growing bushes and trees, or any other suitable above-ground member desirable to the owner or user of the property. Combinations of such above-ground members may be used. For purposes of simplifying claim language, these various above-ground members are herein collectively defined as "posts." The posts 12 are preferably rigid and resistant to outdoor weathering. Metallic stakes are particularly preferably for use as the posts for suspending the lines.

The path of the two lines may follow a straight line, or alternatively may follow a curved, zig-zag, or box-shaped paths. Such pathways are generally to be defined by the property owner or user with due regard to fencing off a desired plot of ground from trespass by geese. For example, a property abutting a body of water frequented by waterfowl is often preferentially protected by means of a fence as herein described, following a boundary facing the body of water, and with turns from this main boundary into flanks at either or both ends, the flank segments of the fence being sufficiently long to inhibit trespass of waterfowl simply by walking around the end of an otherwise straight fence.

The lines 10, 11 may consist of cotton string, glass fiber, metal wire, plastic filament, or other suitable materials similar in shape and function. Plastic filament is generally preferable. Suitable plastics include, for instance, polyethylene, polypropylene, polyester, nylon or polyvinylidene fluoride. Particularly advantageous are monofilament plastic lines commonly available as fishing lines. Such lines are conveniently obtained, already wound on spools, from suppliers of fishing tackle.

The two lines are preferably suspended in a height range of about 3 inches to about 30 inches above the property surface, more preferably about 5 inches to 20 inches. The first line is preferably suspended at a height of about 3 to 10 inches above the surface of the property along the boundary, more preferably 6 to 8 inches high, and the second line at a height of about 8 to 30 inches above the surface along the same boundary, more preferably 12 to 20 inches high, with a minimum of about 5 inches separation between the first and second lines, more preferably a separation of about 8 to 12 inches between them.

As a general guide, the optimum height of the first line is believed to be at or moderately above the knee joint of a targeted waterfowl. The optimum height of the second line is believed to be below the normal eye level of the waterfowl but at or moderately above the height of the back of the waterfowl. Thus, the waterfowl must simultaneously stoop to step underneath the upper line, while raising itself to step over the first line. In that the size of waterfowl may vary considerably from bird to bird, the heights of the two lines may be varied for best effect. For geese, especially the commonly encountered species known as Canadian geese, it has been found that the first line is optimally suspended at a height of about 7 inches, and the second line is optimally suspended at a height of about 17 inches. A third, and even a fourth, line may be added to the fence in the case of particularly pesky waterfowl, but these added lines are not believed to be necessary in all but the most unusual circumstances.

While the present embodiment is described in terms of first and second lines, the terms "first" and "second" do not have a chronological meaning attached. Either of these lines in a fence row may be set up prior to the other. And, where the first and second lines are sections of one continuous line strung along a first and second path, either path may be set up prior to the other path chronologically.

Figure 2:
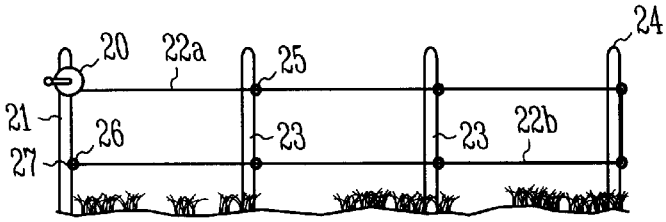
FIG. 2 is a schematic diagram of a retractable goose barrier including a line dispenser.

FIG. 2 shows one embodiment wherein a line dispenser 20 is positioned on a starting post 21, and a line 22*a* is fed from the line dispenser 20 to an ending post 24, following a path generally parallel to the surface of the ground between the starting post and the ending post, the line being suspended therein at a desired or selected height range. Optimally, the line is further continued from the ending post back to the starting post, but at a height range different than the initial path height, therein providing the second line 22*b* of the fence. The path of the line or lines may be generally varied and controlled by additional posts 23 interposed along the path. Such posts 23 may be interposed so as to cause the line to follow a path generally conforming to the contour of the ground surface underneath the line pathway, or to follow a desired boundary which need not be straight but may delineate a curve, a bend, a corner turn, or even a zig-zag. The defined pathway may include, for example, a connection to a dock extending from a waterfront property out into a body of water.

The line dispenser 20 depicted in FIG. 2 advantageously includes a spool of a line, such as a mono filament fishing line, the spool being rotatable within a housing attachable to the starting post. The dispenser preferably includes a means for rotating the spool so as to rewind the line when desired. The dispenser preferably also includes a means for fixing the position of the spool so that the line cannot play out beyond what is desired. This latter feature advantageously allows a user of the goose barrier to fix and hold the line is a reasonably taut condition as it is suspended in its pathway between the starting post and the ending post. It is desirable to locate the spool of line inside of a cover, such that the spool of line is protected from environmental attack by sunlight, precipitation, falling leaves, assault by rodents and other animals, and so forth. Accordingly, one embodiment incorporates a protective enclosure for a spool or a line as a feature of the dispenser. The protective enclosure will preferably include a cavity for accepting a spool of line, a crank means for engaging the spool so as to turn it or alternately to prevent it from turning further, an opening or conduit for communication of the line from the spool to space outside the protective enclosure, and a means for attachment of the protective enclosure to the starting post. Further details of one embodiment of a line dispenser will be described below.

The line 22*a* being fed from the dispenser 20 may be passed along a series of posts 23 on its way to the ending post 24, and may be returned from the ending post 24 through a series of posts 23 to a termination at the starting post 21. Attachment to each of these posts may be by any number of means. However, it is preferable to provide a means of attachment 25 whereby the line may be easily attached and also easily withdrawn. Such means of attachment 25 may include, for example, a slot, a loop, a hook, or an orifice in the post. Particularly advantageous is a line guide patterned after a wire hose clamp, wherein the ends of the hose clamp are formed into loops for accepting and guiding the line, the clamp being made of spring steel so that it can be easily moved up or down a post to a desired height. The line preferably will have a loop 26 or similar means of engagement at its end, whereby the line may be facilely attached to a protuberance 27 (such as the head of a screw) on a post at the termination of the line pathway. The loop 26 or other means of engagement on the end of the line will preferably be of small size, such that upon rewinding of the line onto the spool, the end of the line will easily pass through the attachment points 25 on each of the posts without snagging or jamming. In a variation of the invention where the line terminates on a post from which the line is also dispensed, the end of the line may advantageously be durably affixed to this post, and yet be part of a retractable fence. This is further elaborated below.

Figure 3:
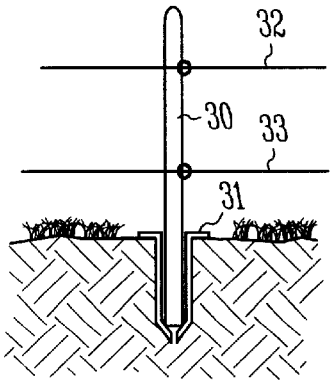
FIG. 3 is a schematic diagram illustrating a means for erecting a post of a retractable barrier.

It is one desired feature of the invention that the goose barrier be easily set up and easily taken down. The user of the property will likely desired unfettered access to the ground surface under the goose barrier for purposes of mowing the grass or otherwise grooming the surface. Also, when full recreational use of the property is intended, the fence may constitute a nuisance at such a time. Facile removal and set up of the fence may be accomplished when the line is easily retractable and the posts are easily removed. Means to make the line easily retractable have been presented immediately above. The posts themselves are conveniently removed from the boundary if they are removably set into receptacles inserted into the ground. FIG. 3 illustrates a simple means of erecting a post 30, wherein a receptacle 31 is installed into the ground, and an opening in the receptacle receives a post 30 upon which the line or lines 32, 33 are to be attached. When the posts are easily removable and the line extends from a dispenser on the starting post to termination on the self same post, its end being durably affixed to the starting post or otherwise modified so as not to be able to slip back through the wire guides (such as attachment of a washer to the end of the line), the starting post may be picked up and the line retracted onto the spool while the post is walked or otherwise moved along the boundary of the protected property. Wherever an intervening post is encountered, it may be easily picked up as well and carried alongside the starting post, while the line continues to be retracted. Thus, an entire row of posts may be easily removed, with the line remaining in a pathway threaded through the full set of the posts, wherein the line may be wound snugly through the set of posts, actually helping to hold the set of posts adjacent one another, e.g., in a bundle, together for easy handling and storage.

Another desired feature of the present system is a line dispenser which allows the line to be taken out and rewound without become tangled and which rewinds the line evenly upon the spool to prevent further tangles. Such a line dispenser allows the retractable fence of the present system to be indefinitely re-used.

Tangling occurs when the line, during winding on the spool, develops loose segments and/or loops, which tend naturally to extend beyond the confines of the spool winding surface. These loose segments and/or loops thereupon tend to snag upon protuberances and other interior parts of the line dispenser. The line may even curl upon itself, forming whorls that will not play out through the tube. Tangling is an exceedingly difficult phenomenon to avoid in a spool winding operation, but is avoided by the herein described means provided for evenly rewinding the line. The term "evenly" as used herein denotes a generally parallel lay-down of line upon the spool edge-to-edge without development of pronounced peaks and valleys that tend to result in loops, tangles or snarls. The term "evenly" is not meant to convey the sense that the line is wound in perfect uniformity edge-to-edge across the spool winding surface.

Figure 4:
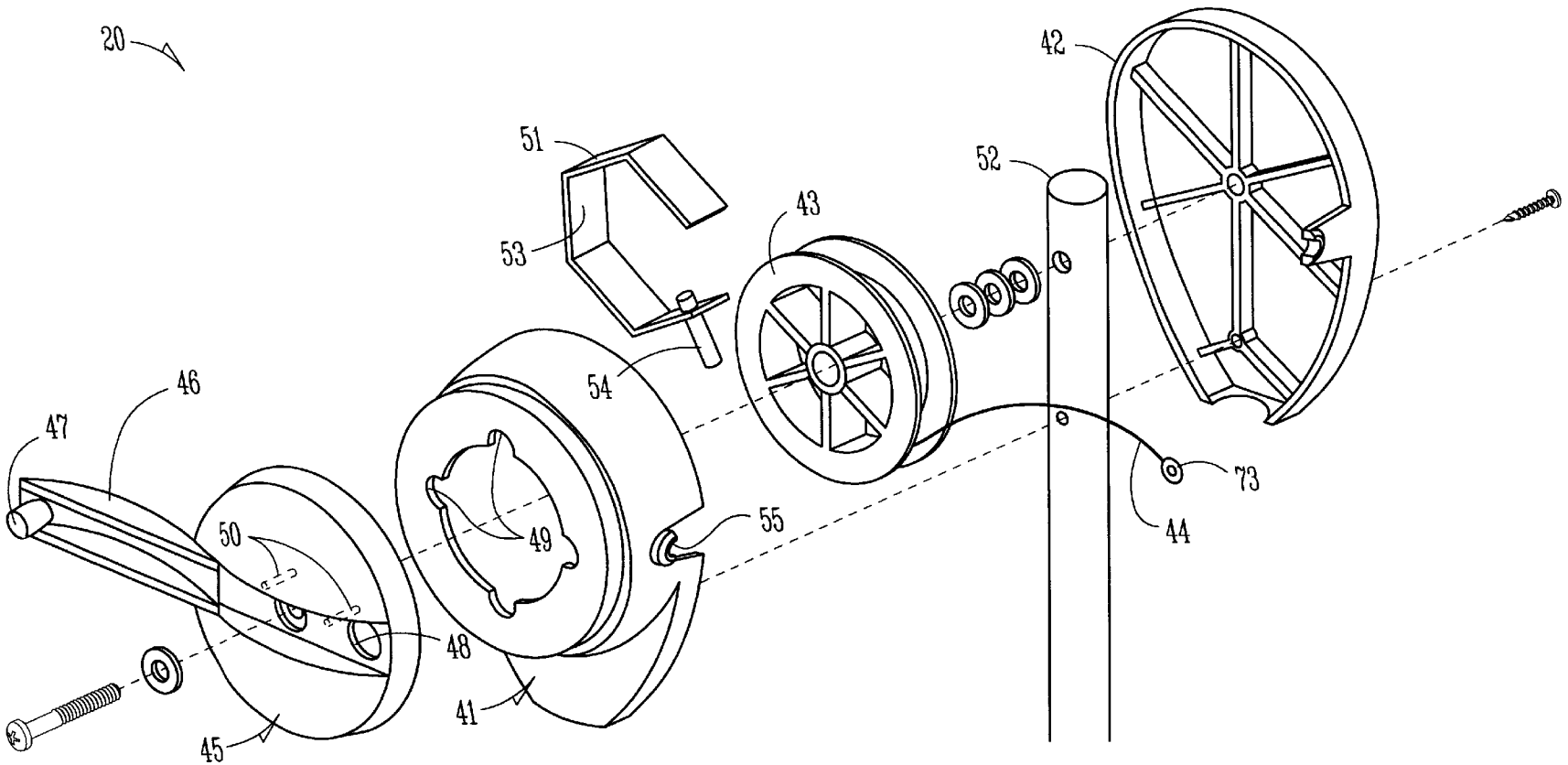
FIG. 4 is an exploded view of a line dispenser according to one embodiment.

FIG. 4 shows an exploded view of line dispenser 20 according to one embodiment. Line dispenser 20 includes a front shell 41 and rear shell 42 which attach together to form an enclosure or housing for a length of line 44 which is spooled upon a spool 43.

Line dispenser 29 further includes a crank assembly 45 which includes one or more engaging members 50 extending rearward from the crank assembly. The one or more engaging members 50 couple with spool 43. When crank assembly 45 is rotated, engaging members 50 apply a rotational force on spool 43 which turns the spool to bring the line 44 in upon the spool.

Crank assembly 45 also includes a handle 46 which is rotatably coupled to the main housing of the crank assembly. Handle 46 includes a knob 47 which is used for turning the handle. In FIG. 4, handle 46 is shown rotated to an open position. When handle 46 is rotated into a closed position, knob 47 extends through a hole 48 in the main body of crank assembly 45 and couples within one of notches 49 on front shell 41. This prevents the crank assembly 45 from being rotated. This in turn stops spool 43 from turning and either bringing in or letting out any line 44. At the end of line 44 a ring 73 is tied.

Crank assembly 45, front shell 41, spool 43, and rear shell 42 are assembled together and mounted to a post 52 using bolts or other fastening means. Line dispenser assembly 20 also includes a hole 55 for communicating line 44 to the outside. A user opens handle 46 which allows spool 43 to rotate within the housing and pulls out line 44 when the user wants to set up a fence as described above. When the fence is set, handle 46 is rotated back into a closed position and knob 47 mates with one of notches 49 to prevent the crank assembly from turning in either direction. To reel in line 44, a user opens handle 47 and turns the crank, extensions members 50 engage spool 43, which is rotated and line 44 is brought in upon the spool.

Mounted proximate spool 43 is a tensioning member 51 which prevents the line from being tangled as it is pulled out of and reeled back into the line dispenser The tensioning member also provides that the line is reeled generally evenly upon the spool without any prominent peaks and valleys forming in the surface of the spooled line. In other words, the line winds upon the spool in a generally uniform left-to-right, then right-to-left, etc. manner. This allows the fencing system described herein to be indefinitely re-used. In one embodiment, tensioning member 51 includes a strip member 53 and a tube 54.

Figure 5:
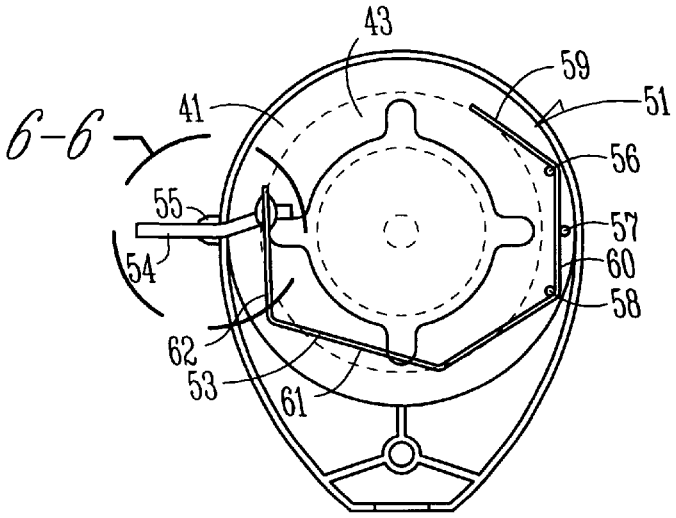
FIG. 5 is a cross-sectional view of portions of the line dispenser of FIG. 4.

FIG. 5 shows further details of tensioning member 51 mounted to front shell 41. In one embodiment, strip member 53 is a c-shaped member which fits engagingly around spool 43. In one embodiment, member 53 includes a stainless steel strip body which includes five relatively straight sections which are angled relative to each other to provide the final c-shape. Among the five sections of member 53 are a first section 59, a second section 60, a fourth section 61, and a last section 62. Second section 60 is mounted to front shell 41 by intertwining section 60 through three posts 56–58 extending from the front shell. Alternatively, posts 56–58 can be positioned on front shell 41 so that one or more of the other sections of strip member 53 can be mounted thereto.

The nominal, unstretched dimension of the perimeter of strip member 53 is smaller than the diameter of spool 43. According, when the c-shaped member is mounted on the spool, one or more of the sections of strip member 53 bias against spool 43. For instance, in the present example, fourth section 61 contacts the spool surface. This puts resistance on the spool to keep it from spinning too fast and developing slack or loops in the line. Moreover, strip member 53 has a width which is approximately slightly smaller than the width of spool 43. Thus, when strip member 53 is mounted on the spool, it generally covers the open surface area of the exposed portion of line 44. This helps prevent the line from falling off the spool as it is being put on or off the spool. Moreover, the close proximity of strip member 53 to the inside wall of spool 43 helps prevent line 44 from coming off the side of the spool when line 44 is pulled out or being rewound. Consequently, line 44 does not become tangled on the center bolt of the line dispenser, other internal parts of the line dispenser, or other loops from spool 43.

In one embodiment, tube 54 is mounted through the last section 62 of strip member 53 and positioned so that tube 54 extends through hole 55 when the line dispenser is assembled. Line 44 is fed through tube 54 to reach the outside of the housing. Tube 54 also helps provide tension and prevent slack on the line, and helps control the line as the line is reeled in upon the spool so that the line is evenly wound across the surface of the spool. Tube 54 is biased by strip member 53 towards the surface of the spool. In one example, the inner end of the tube is directly in contact with the spooled line as the line is reeled in upon the spool.

Figure 6:
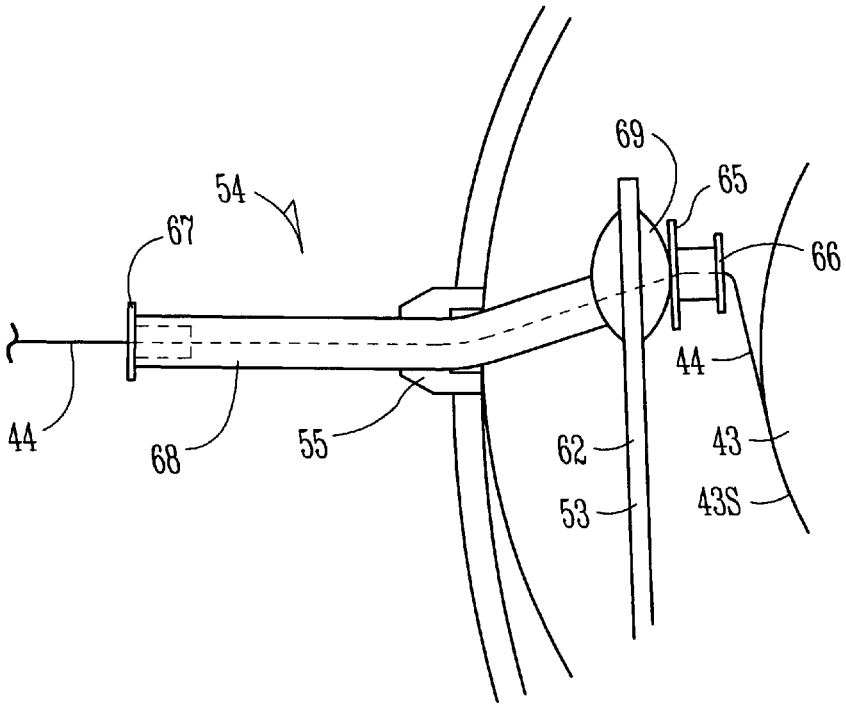
FIG. 6 is a detailed view of a portion of the line dispenser of FIG. 4.

FIG. 6 shows further details of tube 54. In one embodiment, tube 54 includes a main tube member 68, first and second inserts 66 and 67, and a washer 65. Other embodiments omit one or more of these members. In one embodiment, main tube member 68 is an approximately 1½ inch plastic tube having an inside diameter of approximately ⅛ inch. The tube is held in place within a hole in last section 62 of member 53 by a grommet 69. Grommet 69 is an elastomeric member which allows tube 54 to be resiliently mounted. This allows some flexibility in the position of tube 54 when mounting tube 54 within the line dispenser housing.

Inserts 66 and 67 are hardened plastic inserts which are press-fit within the ends of main tube member 68. Inserts 66 and 67 protect main tube member 68 from being cut during action of line 44.

Washer 65 is located between the inner end of main tube member 68 and grommet 69. Washer 65 can be a separate piece attached to tube member 68 or it can be integrally molded with the tube. Washer 65 helps hold tube member 68 within grommet 69 when a pulling force is applied to line 44.

In use, when line 44 is pulled out of the housing, the line applies a force on tube 54 which pulls the tube slightly through hole 55. Strip member 53 is resilient so the strip member flexes and allows the tube to slightly move. This pulls last section 62 of strip member 53 off of spool 43 near the point where line 44 is coming off of the spool. As noted above, when the line is being reeled back onto the spool, last section 62 biases the end of tube 54 towards the surface of the spool of line on spool 43. Accordingly, strip member 53 provides a spring action in positioning the tube relative to the spool winding surface. This helps prevent slack or loops from being created in the line. In one embodiment, tube 54 is not mounted to strip member 53 but is mounted by means of a coiled spring or other equivalent means that biases the tube to the spool during winding and away from the spool surface during take-off.

Referring to FIG. 6, when line 44 is pulled off of spool 43, the line is at a generally 45 degree angle relative to the surface of the spool at the point the line leaves the spool. Other embodiments change the relative angle. For example, various embodiments range from approximately 30 degrees to approximately 60 degrees. Generally, the line is pulled off of the spool at an angle which is non-tangential relative to a surface 43*s* of the line on the spool at the point of release. This configuration helps prevent the spool from rotating too fast since it changes the natural direction of the line and forces it to come off in approximately right angles from the spool. The line also comes off of the spool in the same plane as the rotational plane of the spool. (The plane of FIG. 6). In other words, spool 43 is in a parallel plane with the direction the line is pulled out.

When the line is being cranked back onto the spool, the tensioning device enables the line to be wound on the spool without being tangled. Moreover, by keeping a relatively constant amount of tension in the line as it is being reeled on, the line is tightly wound on the spool. This is important because it helps the line from developing slack or loops when the line is then pulled off the spool.

Moreover, as noted above, the present device also winds the line evenly across the spool without peaks and valleys. This is advantageous since lines on a peak will slip off and cause a later loop to be over an earlier loop, which can result in a tangled line. The present device provides even winding without a complex mechanism as is usually found in devices such as fishing reels, which typically have a guide member which physically forces the line back and forth across the spool to provide even winding. In contrast, the present device, by providing tension and flexibility via the tube member and the biased metal strip, naturally provides for an evenly wound spool. Thus, strip member 53 biases the inside end of the tube towards the surface 43*s* of the spooled line as the line is reeled in, but it has enough flexibility to gradually move outwards (while still biasing inward) as the amount of line on the spool grows. Moreover, at least a portion of strip member 53, (for instance, section 61 of FIG. 5), is biased against the surface of the spool to help guide the line and force it into place as it comes in through the tube member.

Overall, the present invention provides a non-complex mechanism for providing tension in the line, as opposed to a fishing reel, for example, which can have a multitude of complex interdependent moving parts.

Some major factors in predicting whether the line 44 will tangle and wind evenly are the length of tube member 68, the diameter of the tube, and the diameter of the line. Accordingly, the present invention is not limited to nor exhausted by the present examples. Other tube and line combinations will be apparent to these skilled in the art upon reading the present disclosure. In various embodiments, for example, the tube can range in length from approximately ½ inch to greater than 2 inches, the tube diameter can range between approximately 0.125 inches to approximately 0.19 inches, and the line diameter can range from approximately 0.006 inches to approximately 0.03 inches. In one embodiment, a tube length of approximately 1.5 inches, a tube diameter of approximately ⅛ inches, and a monofilament line diameter of approximately 0.023 inches is used.

Thus, by means of the designs and features illustrated in the above description, a property user or owner may conveniently erect a goose barrier fence that is easily put up, easily retracted, and easily re-used. In some embodiments, the fence can be very non-obtrusive to property owners and users, in that a line consisting of a transparent plastic monofilament may he chosen such that a goose most definitely perceives the line when approaching the fence, but the owner or property user does not perceive the line from a distance, and is not visually repulsed by such an unobtrusive fence. In a situation wherein the owner or property user wants increased visibility of the fence, flags may be affixed to either line, both lines, or to any point on the line wherein a single overall line is strung through a set of posts. The flags may consist of any of a number of materials such as cloth, plastic, or metal, including metallic foil and colored string as examples. Optionally, such flags may be loosely attached onto the line so as to allow sliding contact of the line during retraction of the fence. Alternatively, the flags may be easily disengaged from the line. Any number of means for hanging or affixing flags to a line will be evident an owner or user of the fence.

CONCLUSION

Among other advantages, the present system provides a retractable fence having easy installation, easy uninstallation, easy maintenance, and a substantially tangle-free system of extending and retracting the fence.

One aspect of the present system includes a line dispenser for a retractable fence which is substantially tangle-free as the line is reeled into and pulled out of the line dispenser and which provides that the line is reeled upon the spool evenly without peaks and valleys. Accordingly, the device can be re-used and is easily assembled and disassembled.

Another aspect of the present system provides a retractable fence which is easily removable when the owner or user of the property desires unfettered access to the full property, and is easily re-erected.

It is understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A line dispenser for a retractable fence, the line dispenser comprising:

a housing having a hole;

a spool within the housing having a length of line thereon; and a tensioning member including a strip member mounted around a portion of a perimeter of the spool and a tube extending through the hole, wherein the line extends through the tube;

wherein the strip member comprises a c-shaped metal strip which is dimensioned to grippedly mount around a perimeter of the spool and at least partially contact the line thereon.

2. The line dispenser of claim 1, further comprising a crank assembly which includes an extension member which is couplable with a corresponding portion of the spool, wherein when the crank assembly is rotated the spool is rotated by the extension member.

3. The line dispenser of claim 2, wherein the housing includes a notch which is couplable with the crank assembly to prevent the crank assembly from rotating.

4. The line dispenser of claim 1, wherein the tube is mounted within a hole in the strip member.

5. The line dispenser of claim 1, wherein the tube is positioned relative to the spool so that the line comes off the spool at an angle between approximately 30 degrees and approximately 60 degrees relative to a surface of the spool of line.

6. A retractable fence comprising:

a line dispenser which holds a rotatable spool having a length of line thereon, the line dispenser being mounted on a starting post;

means for rewinding said line onto the rotatable spool; and at least one secondary post, said line traversable from the starting post to the secondary post and back to the starting post;

wherein the starting post and at least one secondary post are set in receptacles and are reversibly removable therefrom;

wherein the line dispenser further comprises a tensioning member which includes a strip member mounted around a portion of a perimeter of the spool and a tube extending through a hole in the line dispenser, wherein the line extends through the tube, and wherein the strip member comprises a c-shaped metal strip which is dimensioned to grippedly mount around a perimeter of the spool and at least partially contact the line thereon.

7. The fence according to claim 6 wherein said line comprises a polymeric monofilament line.

8. The fence of claim 6, wherein the tube is mounted within a hole in the strip member.

9. The fence of claim 6, wherein the tube is positioned at a generally 45 degree angle relative to the surface of the spool of line.

10. The fence of claim 6, wherein means for rewinding comprises a crank assembly which includes an extension member which is couplable with a corresponding portion of the rotatable spool, wherein when the crank assembly is rotated the rotatable spool is rotated by the extension member.

11. The fence of claim 6, wherein the starting post and the at least one secondary post each include line guides for suspending the length of line, wherein the line guides are located to position the length of line in a continuous fashion wherein the length of line defines two substantially parallel lines, wherein a first of the two substantially parallel lines is suspended at a height of about 3 to 10 inches above a surface and a second of the two substantially parallel lines is suspended at a height of about 8 to 30 inches above the surface.

12. The fence of claim 11 wherein the line guides of the starting post and the at least one secondary post are located to provide at least about 5 inches separation between the first and second lines.

13. A tensioning member for controlling a line as the line is being rewound on a spool, the tensioning member comprising a tube member flexibly biased towards a surface of the spool, wherein the line extends through the tube member.

14. The tensioning member of claim 13, further comprising a strip member mounted around the spool, wherein the tube member is mounted to the strip member.

15. The tensioning member of claim 14, wherein the tube member does not move across the surface of the spool as the line is rewound on the spool.

16. The tensioning member of claim 13, wherein the tube has an inner diameter of approximately ⅛ inch.

17. A method for controlling a line as the line is being rewound upon a spool, the method comprising bringing the line through a tube member as the line is being rewound and biasing a first end of the tube member towards a surface of the spool.

18. The method of claim 17, further comprising mounting the tube member to a flexible strip member mounted on the spool.

19. The method of claim 18, wherein the flexible strip member includes at least a portion contacting the surface of the spool.

20. The method of claim 17, wherein bringing the line through a tube member includes bringing the line through a tube member having an inner diameter of approximately ⅛ inch.

21. A method for rewinding a retractable fence, the method comprising:

cranking a length of line upon a spool;

providing tension on the line as the line is being cranked by bringing the line in through a tube member which is mounted to a strip member which is flexibly biased around the spool.

22. The method of claim 21, further comprising guiding the line back and forth evenly across a surface of the spool as the length of line is rewound.

* * * * *